US010156040B2

(12) United States Patent
Dolsey et al.

(10) Patent No.: US 10,156,040 B2
(45) Date of Patent: Dec. 18, 2018

(54) KITS AND METHODS OF TREATING A SUBSTRATE PRIOR TO FORMATION OF AN IMAGE THEREON

(71) Applicant: Neenah, Inc., Alpharetta, GA (US)

(72) Inventors: Russell Dolsey, Roswell, GA (US); Francis J. Kronzer, Woodstock, GA (US); Melanie K. Calkins, Marietta, GA (US)

(73) Assignee: Neenah, Inc., Alpharetta, GA (US)

( * ) Notice: Subject to any disclaimer, the term of this patent is extended or adjusted under 35 U.S.C. 154(b) by 0 days.

(21) Appl. No.: 15/360,252

(22) Filed: Nov. 23, 2016

(65) Prior Publication Data

US 2017/0073883 A1 Mar. 16, 2017

Related U.S. Application Data

(60) Continuation of application No. 14/731,655, filed on Jun. 5, 2015, now Pat. No. 9,523,166, which is a (Continued)

(51) Int. Cl.
*D06M 11/155* (2006.01)
*D06B 1/10* (2006.01)
(Continued)

(52) U.S. Cl.
CPC ..... *D06M 11/155* (2013.01); *D06B 1/10* (2013.01); *D06B 23/14* (2013.01);
(Continued)

(58) Field of Classification Search
CPC ... D06M 11/155; D06P 5/205; D06P 1/67358; A47K 2010/3266; A47K 2010/3273
See application file for complete search history.

(56) References Cited

U.S. PATENT DOCUMENTS 4,429,014 A * 1/1984 Isner ..... A47L 13/16 15/209.1
5,716,900 A 2/1998 Kronzer et al.
(Continued)

FOREIGN PATENT DOCUMENTS

EP 0842786 5/1998
GB 1531990 11/1978
(Continued)

OTHER PUBLICATIONS

International Search Report for corresponding PCT Application No. PCT/US2013/030675.

*Primary Examiner* — Nathan H Empie
(74) *Attorney, Agent, or Firm* — Meunier Carlin & Curfman LLC

(57) ABSTRACT

Methods and kits for treating a fibrous substrate prior to forming an image thereon are provided. The method can include positioning a treatment sheet adjacent to the fibrous substrate, transferring a salt (e.g., calcium chloride, magnesium chloride, or a mixture thereof) from the treatment sheet to the fibrous substrate using a wetting solution (e.g., an aqueous solution, such as water) to carry the salt from the treatment sheet into the fibrous substrate, and drying the fibrous substrate such that the salt remains in the substrate. For example, the transfer of the salt from the treatment sheet into the fibrous substrate can be accomplished via pressing the backside of the treatment sheet such that the wetting solution flows from the treatment sheet into the fibrous substrate while carrying the salt.

19 Claims, 6 Drawing Sheets

Related U.S. Application Data division of application No. 13/423,787, filed on Mar. 19, 2012, now abandoned.

(51) Int. Cl.

| | |
|---|---|
| ***D06B 23/14*** | (2006.01) |
| ***D06P 5/00*** | (2006.01) |
| ***D06P 5/22*** | (2006.01) |
| ***D06P 5/30*** | (2006.01) |
| ***D06P 1/673*** | (2006.01) |
| *D06M 101/06* | (2006.01) |

(52) U.S. Cl.

CPC ..... *D06P 1/67333* (2013.01); *D06P 1/67358* (2013.01); *D06P 5/001* (2013.01); *D06P 5/22* (2013.01); *D06P 5/30* (2013.01); *D06M 2101/06* (2013.01)

(56) References Cited

U.S. PATENT DOCUMENTS

| | | | | |
|---|---|---|---|---|
| 6,200,668 | B1 | 3/2001 | Kronzer | |
| 6,326,323 | B1 * | 12/2001 | Shimano | D06N 3/0056 428/32.16 |
| 6,838,132 | B1 | 1/2005 | Iguchi et al. | |
| 6,916,751 | B1 | 7/2005 | Kronzer | |
| 7,199,182 | B2 | 4/2007 | Tanaka et al. | |
| 7,361,247 | B2 | 4/2008 | Kronzer | |
| 7,364,636 | B2 | 4/2008 | Kronzer | |
| 7,604,856 | B2 | 10/2009 | Kronzer et al. | |
| 8,205,981 | B1 * | 6/2012 | Marino | B41J 3/4078 347/101 |
| 2003/0103129 | A1 | 6/2003 | Tanaka et al. | |
| 2004/0119801 | A1 | 6/2004 | Suzuki et al. | |
| 2005/0084614 | A1 | 4/2005 | Bagwell et al. | |
| 2007/0056118 | A1 * | 3/2007 | Ellis | C09D 11/322 8/115.51 |
| 2007/0067928 | A1 | 3/2007 | Ellis | |
| 2008/0092309 | A1 | 4/2008 | Ellis et al. | |
| 2011/0033629 | A1 * | 2/2011 | Beneke | C23C 22/34 427/429 |
| 2011/0169901 | A1 * | 7/2011 | Pinto | D06P 1/5235 347/101 |
| 2011/0303113 | A1 | 12/2011 | Sarkisian et al. | |
| 2012/0040148 | A1 | 2/2012 | Mozel et al. | |

FOREIGN PATENT DOCUMENTS

| | | |
|---|---|---|
| WO | WO 99/33669 | 7/1999 |
| WO | WO 2008/033569 | 3/2008 |

* cited by examiner

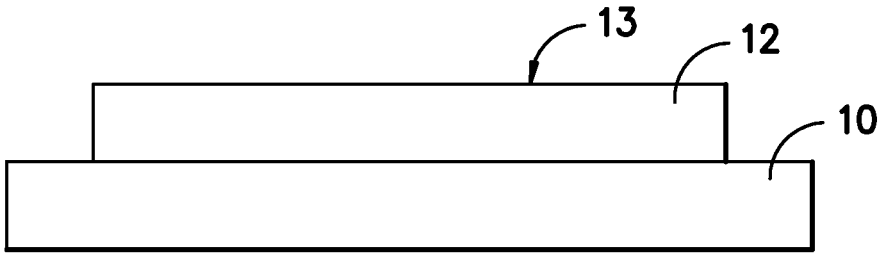
FIG. –1–
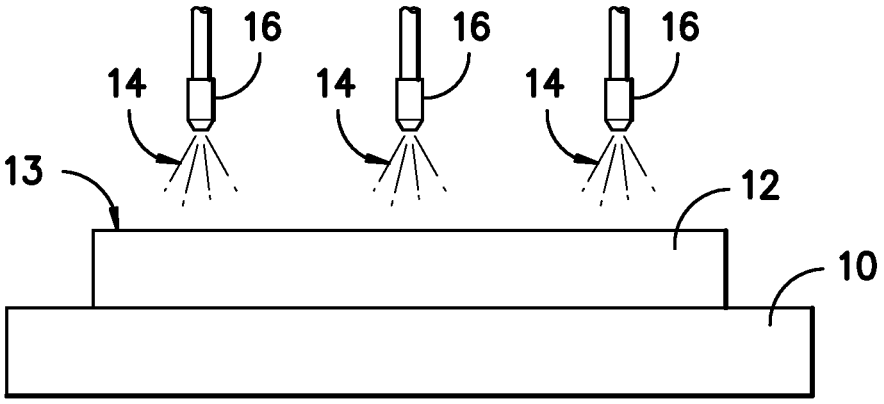
FIG. –2A–
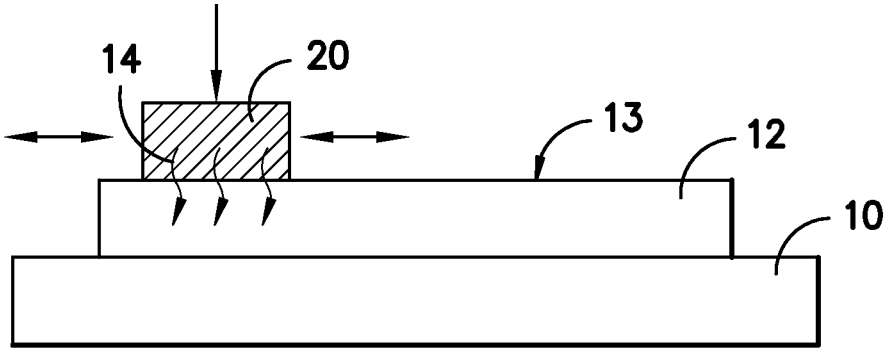
FIG. –2B–

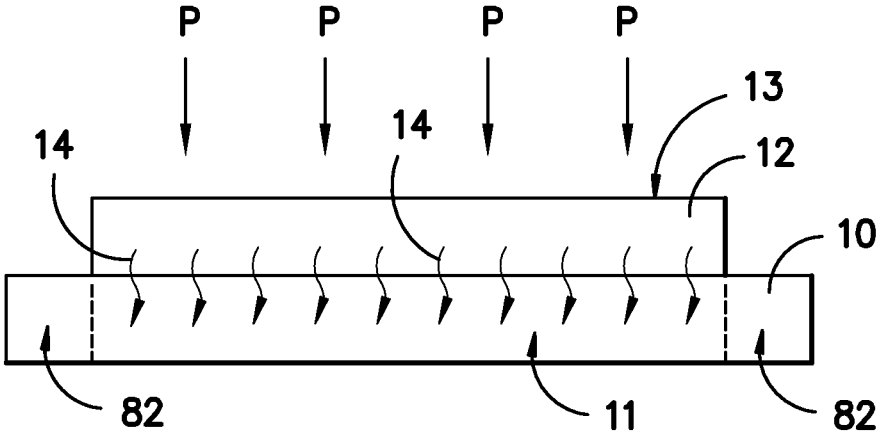
FIG. —3—
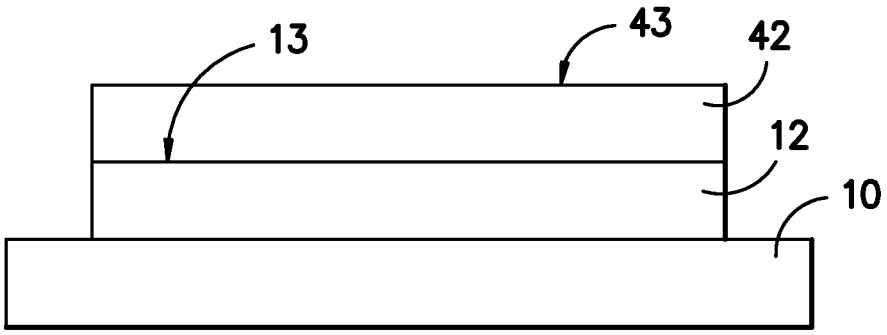
FIG. —4—

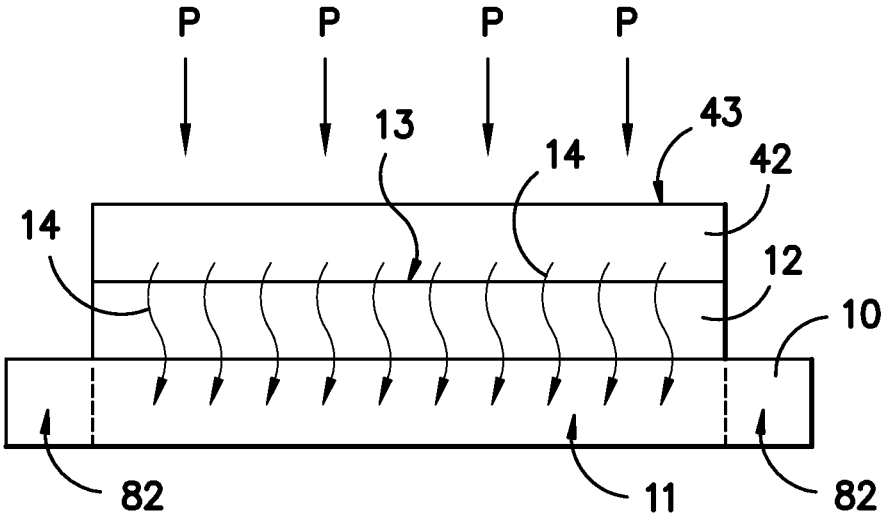
FIG. –5–
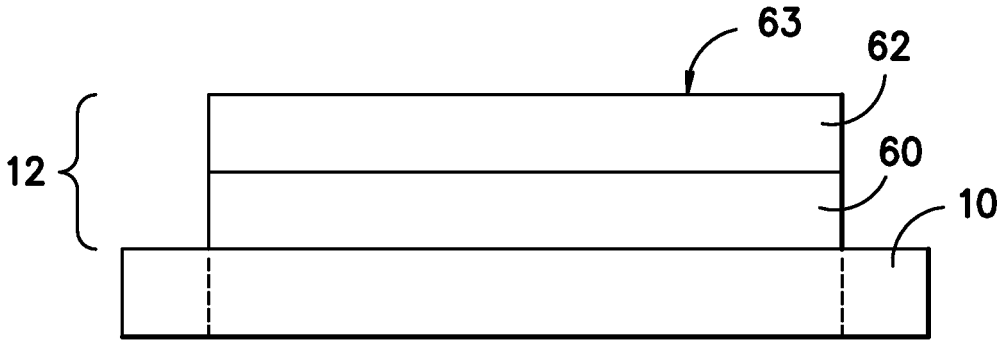
FIG. –6–

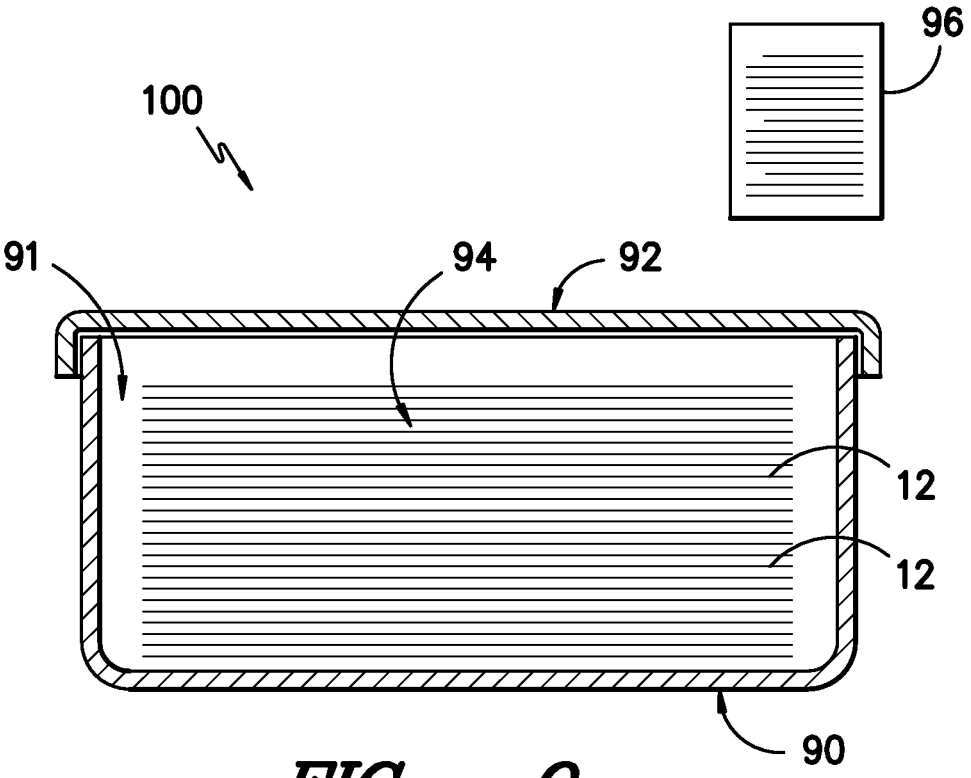
FIG. –9–
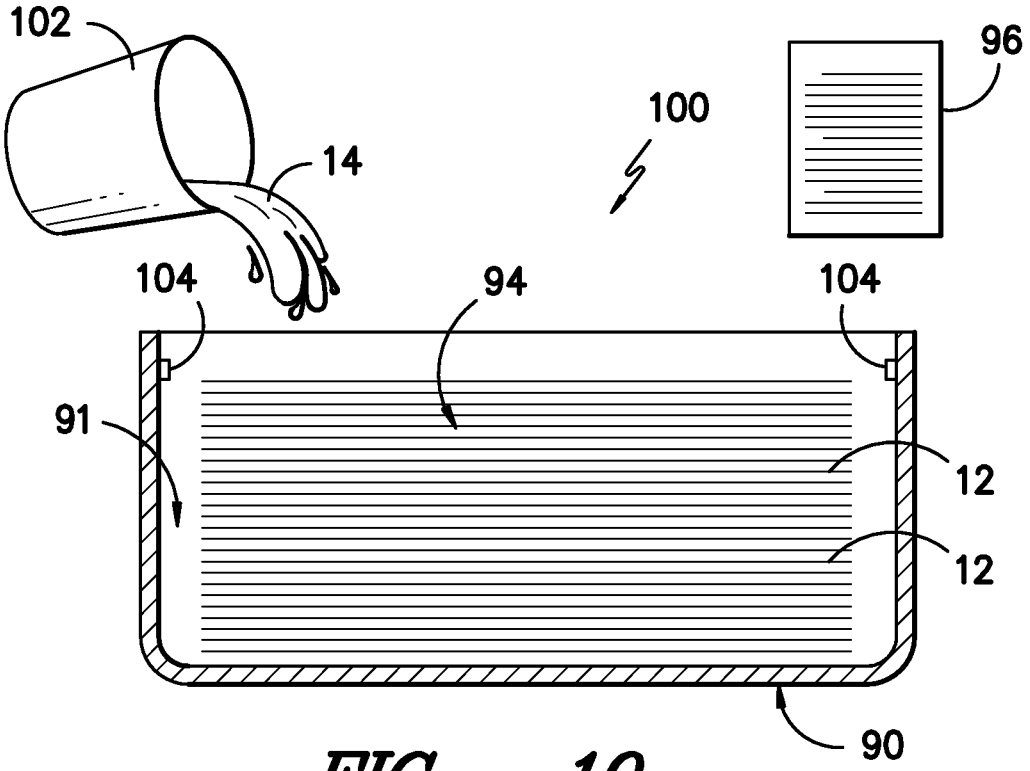
FIG. –10–

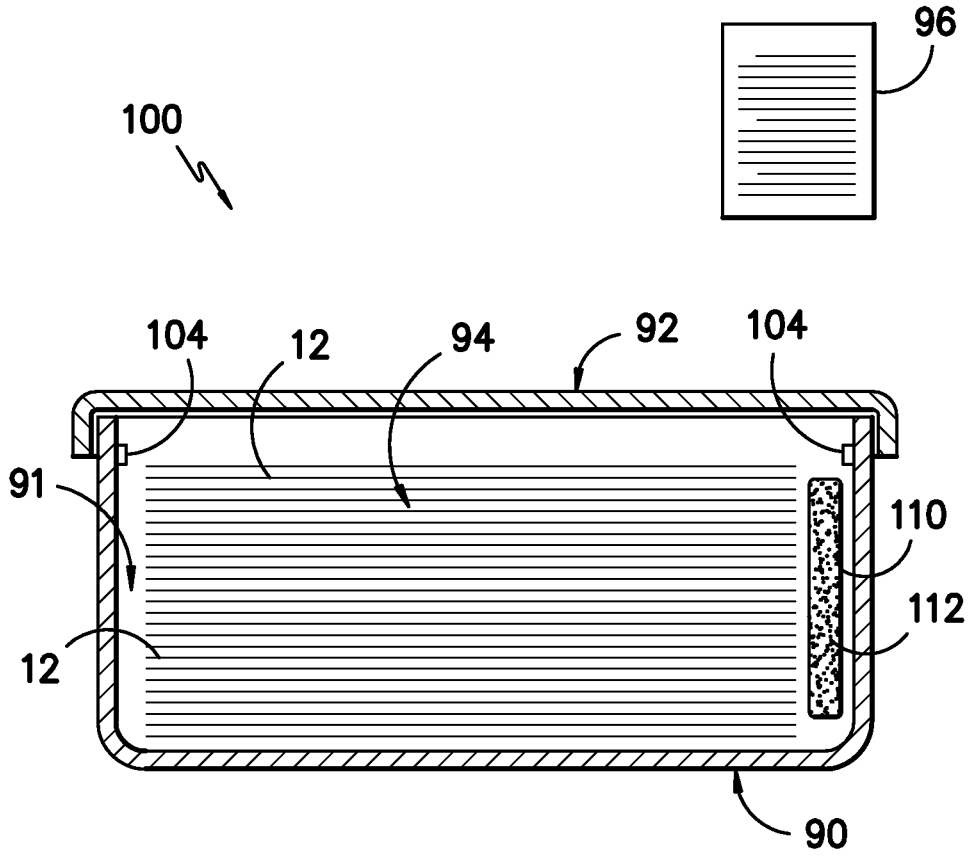
FIG. –11–

KITS AND METHODS OF TREATING A SUBSTRATE PRIOR TO FORMATION OF AN IMAGE THEREON

PRIORITY INFORMATION

The present application claims priority to and is a continuation of U.S. patent application Ser. No. 14/731,655 titled "Kits and Methods of Treating a Substrate Prior to Formation of an Image Thereon" of Dolsey, et al. filed on a Jun. 5, 2015, which claims priority to and is a divisional of U.S. patent application Ser. No. 13/423,787 titled "Kits and Methods of Treating a Substrate Prior to Formation of an Image Thereon" of Dolsey, et al. filed on Mar. 19, 2012; the disclosures of which are incorporated by reference herein.

BACKGROUND OF THE INVENTION

Images are often formed on a cloth garment (e.g., a shirt) via a heat transfer method or a direct-to-garment printing method. Depending on the cloth garment imaged, it is often desired to pre-treat the garment before forming the image. The pretreatment can help keep the ink on the surface of the garment and/or form a strong bond between the image and the garment.

For example, a treatment composition can be sprayed directly onto the garment. However, this spray method can apply the treatment composition unevenly across the surface area (and/or the thickness) of the garment. For instance, the treatment composition may be applied heavily in certain areas and lightly in other areas. Thus, due to the uneven application of the treatment composition to the garment, the depth that the ink penetrates the fibrous substrate across the cloth may be uneven, resulting in an image that will appear uneven. This unevenness is especially apparent when forming an image on a dark cloth using lighter colors (e.g., white).

Alternatively, the garment can be dipped and/or submerged into the treatment composition. However, this application results in the treatment composition being applied across the entire surface area of the garment. Thus, even the areas of the garment that are not going to be imaged (i.e., that will be free from an image) have the treatment composition present, resulting in wasted treatment composition.

Therefore, a need exists for an improved method of pretreating a cloth garment prior to forming an image thereon.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which:

FIG. 1 shows an exemplary treatment sheet positioned adjacent to a substrate;

FIGS. 2A and 2B show exemplary steps of wetting the treatment sheet of FIG. 1 with a wetting solution;

FIG. 3 shows an exemplary step of transferring the wetting solution from the treatment sheet of FIG. 2A or 2B into the substrate via applying pressure thereto;

FIG. 4 shows an exemplary step of wetting the treatment sheet of FIG. 1 via applying a wet sheet adjacent to the treatment sheet;

FIG. 5 shows an exemplary step of transferring the wetting solution from the wet sheet of FIG. 4, through the treatment sheet, and into the substrate via applying pressure thereto;

FIG. 6 shows another exemplary treatment sheet positioned adjacent to a substrate, with the treatment sheet including a base sheet and a film layer;

FIG. 9 shows an exemplary kit for treating a fibrous substrate prior to forming an image thereon;

FIG. 10 shows an exemplary step of using a kit for treating a fibrous substrate prior to forming an image thereon; and FIG. 11 shows another exemplary kit for treating a fibrous substrate prior to forming an image thereon.

Figure 7:
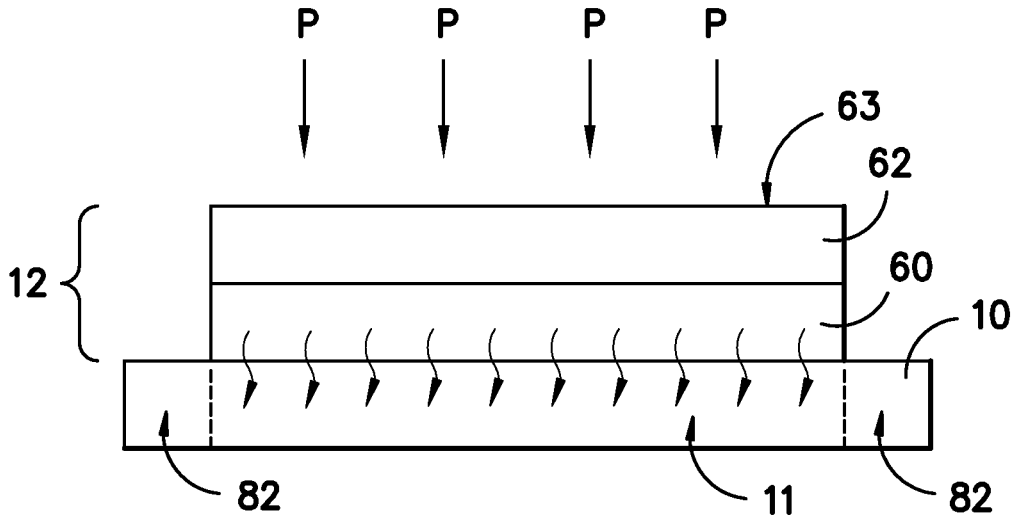
FIG. 7 shows an exemplary step of transferring the wetting solution from the treatment sheet of FIG. 6 into the substrate via applying pressure onto the film layer.

Repeat use of reference characters in the present specification and drawings is intended to represent the same or analogous features or elements of the present invention.

SUMMARY

Objects and advantages of the invention will be set forth in part in the following description, or may be obvious from the description, or may be learned through practice of the invention.

Methods and kits are generally provided for treating a fibrous substrate prior to forming an image thereon. In one embodiment, the method includes positioning a treatment sheet adjacent to the fibrous substrate, transferring a salt (e.g., calcium chloride, magnesium chloride, or a mixture thereof) from the treatment sheet to the fibrous substrate using a wetting solution (e.g., an aqueous solution, such as water) to carry the salt from the treatment sheet into the fibrous substrate, and drying the fibrous substrate such that the salt remains in the substrate. For example, the transfer of the salt from the treatment sheet into the fibrous substrate can be accomplished via pressing the backside of the treatment sheet such that the wetting solution flows from the treatment sheet into the fibrous substrate while carrying the salt.

In one embodiment, the treatment sheet can be substantially dry when positioned adjacent to the fibrous substrate. In such an embodiment, transferring the salt from the treatment sheet to the fibrous substrate can be accomplished by adding the wetting solution to a backside of the treatment sheet after positioning the treatment sheet adjacent to the fibrous substrate. For instance, the wetting solution can be sprayed onto the backside of the treatment sheet. Alternatively, a wet sheet (saturated with the wetting solution) can be positioned adjacent to the backside of the treatment sheet, and pressed to pass the wetting solution from the wet sheet through the treatment sheet and into the fibrous substrate.

In another embodiment, the treatment sheet can be saturated with the wetting solution when positioned adjacent to the fibrous substrate. In such an embodiment, the salt can be transferred from the treatment sheet to the fibrous substrate via pressing the backside of the treatment sheet such that the wetting solution flows from the treatment sheet into the fibrous substrate while carrying the salt.

The treatment sheet can include the base sheet (e.g., that comprises pulp fibers). For example, the base sheet can be a paper web, a hydroentangled web, or a coform web. In certain embodiments, the base sheet can be laminated to a film or other support sheet.

Kits are also generally provided for treating to a fibrous substrate prior to forming an image thereon. In one embodiment, the kit can include a water-proof container configured to keep moisture out of the interior space when sealed, a plurality of treatment sheets positioned within the interior space of the water-proof container, and a treatment composition comprising a salt (e.g., calcium chloride, magnesium chloride, or a mixture thereof). For example, the treatment composition can be saturated within each treatment sheet, that is either substantially dry or saturated with a wetting solution. Alternatively, the treatment composition can be positioned within a pouch configured to be substantially water-tight. Instructions can also be present in the kit, and can direct a user on the steps to be performed to pretreat a fibrous substrate using the kit.

Other features and aspects of the present invention are discussed in greater detail below.

DEFINITIONS

As used herein, the term "printable" is meant to include enabling the placement of an image on a material, especially through the use of ink-jet inks.

As used herein, the term "polymeric film" is meant to include any sheet-like polymeric material that is extruded or otherwise formed (e.g., cast) into a sheet. Typically, polymeric films do not contain discernable fibers.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

Chemical elements are discussed in the present disclosure using their common chemical abbreviation, such as commonly found on a periodic table of elements. For example, hydrogen is represented by its common chemical abbreviation H, helium is represented by its common chemical abbreviation He; and so forth.

In the present disclosure, when a layer is being described as "on" or "over" another layer or substrate, it is to be understood that the layers can either be directly contacting each other or have another layer or feature between the layers, unless otherwise stated. Thus, these terms are simply describing the relative position of the layers to each other and do not necessarily mean "on top of" since the relative position above or below depends upon the orientation of the device to the viewer.

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

Methods are generally provided for treating a substrate prior to forming an image thereon. Specifically, a treatment composition (e.g., a salt) can be transferred from a treatment sheet into a fibrous substrate. According to particular embodiments of the presently disclosed methods, the treatment composition can be transferred so as to be present in and/or on the fibrous substrate in a substantially evenly distributed manner in the treated areas. In one embodiment, the treatment composition can be applied into and/or onto the substrate without the use of a spraying unit.

Kits are also generally provided, along with their methods of formation. The kits can supply the materials to a user that can then treat a fibrous substrate prior to forming an image thereon.

In certain embodiments, the application of the treatment composition can be controlled such that the treatment composition is applied to the areas where an image is to be formed (i.e., imaged areas) to form treated areas. For example, the treatment composition can be applied only to the areas where an image is to be formed (i.e., imaged areas), while leaving the other areas, corresponding to the areas of the substrate that remain unimaged, substantially free from the treatment composition. Thus, there can be treated areas on the garment (where the treatment composition has been transferred), and untreated areas on the garment that are substantially free from the treatment composition. According to one embodiment of the method, the treatment composition can be applied substantially evenly across the treated areas.

As stated, the presently disclosed methods generally involve transferring a treatment composition (e.g., a salt) from a treatment sheet to the substrate. This transfer can be achieved according to several methods. The treatment composition transferred to the substrate to form the treated areas can, in one particular embodiment, include a salt. For example, the salt can be calcium chloride, magnesium chloride, or a mixture thereof.

The amount of salt that can be applied may be varied as desired based on the particular fibrous substrate treated, but will generally be in an amount sufficient to keep a majority of the colorant of the image near the surface of the substrate. For example, at least 50% of the colorant (e.g., dye, pigment, etc.) of the image can penetrate less than about 25% of the thickness of the fibrous substrate. Without wishing to be bound by any particular theory, it is believed that the salt component of the treatment composition (which is present within the thickness of the fibrous substrate) can draw the ink solvent quickly into the interior of the fibrous substrate causing the colorant material of the ink to remain on or near the surface of the substrate. Thus, the colorant material of the ink can be quickly dried to remain on or near the surface of the substrate. This advantage is particularly suitable for direct-to-garment printing on the treated areas.

While the treatment composition may include only a salt or a mixture of salts (e.g., being substantially free from any other material), other materials may also be included in the treatment composition. For example, an acrylic binder may also be included in the treatment composition to help bond the colorant of the image to the fibrous substrate. For example, a non-ionic and/or cationic acrylic binder can be included in the treatment composition. Suitable polyacrylic binders can include polymethacrylates, poly(acrylic acid), poly(methacrylic acid), and copolymers of the various acrylate and methacrylate esters and the free acids; ethylene-acrylate copolymers; vinyl acetate-acrylate copolymers, and the like. Suitable acrylic polymers that can be utilized as a binder in the treatment composition include those acrylic latexes sold under the trade names Rhoplex by Rohm and Haas (Wilmington, Del.) and/or HYCAR® by Lubrizol, Inc. (Cleveland, Ohio). Other cationic additives may be employed, such as APC-M1 from Ghen Materials, a tertiary amine salt of MDAA (methyl diallylamine) and Glascol F207 from CIBA Specialty Chemicals, and APC-A1, which are examples of a quarternary ammonium salt of DADMAC (dimethyl diallylammonium chloride).

As will be discussed below, the treatment composition can be applied utilizing a treatment sheet. In one embodiment, the treatment sheet can include a base sheet saturated with a salt. The base sheet can include pulp fibers, such as those suitable for paper making, to form a fibrous web. The fibrous web including pulp fibers can be in the form of a paper web, a spunbond web of synthetic fibers (e.g., polyethylene, polypropylene, or copolymers thereof, or a mixture thereof) that has been hydroentangled with pulp fibers.

The base sheet can be saturated with a solution containing the treatment composition (e.g., a salt), such that the treatment composition is intermixed with the fibers of the web, and contained within the construction of the web. In one embodiment, the treatment sheet can be dried, to remove the solvent of the solution while leaving the salt therein.

Figure 8:
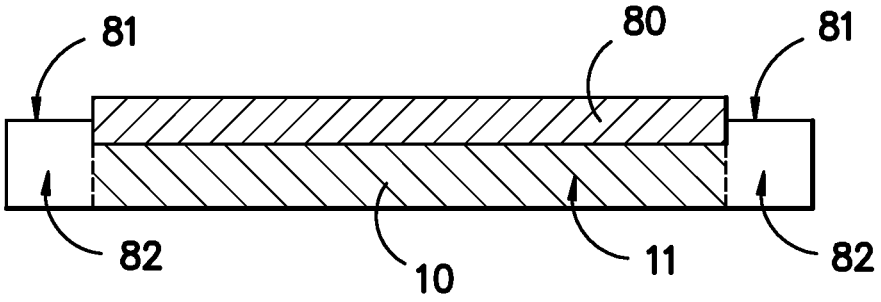
FIG. 8 shows an exemplary substrate that defines an image on the treated area.

No matter the method utilized, the substrate can be imaged onto the treated areas. For example, referring to FIG. 8, an exemplary substrate 10 is shown having a treated area 11 that contains the treatment composition therein and/or thereon. An image 80 is shown formed over the treated areas 11. As shown, unimaged areas 81 (that are substantially free from any image) are present on the substrate 10, and generally correspond to the untreated areas 82 (that are substantially free from any treatment composition) of the substrate 10.

The image 80 can be formed on the substrate 10 by any suitable method. For example, the image 80 can be formed via direct-to-garment printing. Alternatively, the image 80 can be formed via a heat transfer method, such as disclosed in U.S. Pat. No. 7,604,856 of Kronzer, et al., U.S. Pat. No. 7,364,636 of Kronzer, U.S. Pat. No. 7,361,247 of Kronzer, U.S. Pat. No. 6,916,751 of Kronzer, U.S. Pat. No. 6,200,668 of Kronzer, U.S. Pat. No. 5,716,900 of Kronzer, et al., all of which are incorporated by reference herein.

In particular embodiments, the substrate 10 is a fibrous substrate, such as a woven fabric. For example, the substrate 10 can be a woven fabric of any suitable material for use in clothing garments (e.g., cotton, wool, nylon, polyester, or mixtures thereof). The presently disclosed methods are particularly suitable for forming an image on a dark colored fabric.

With reference to each of the following embodiments, the wetting solution can be an aqueous solution that includes water. For example, the wetting solution can be substantially water (i.e., deionized water, tap water, etc.) without a significant amount of any other solvent present. In other embodiments, the wetting solution can include, either substantially alone or in addition to water, an alcohol (e.g., methanol, ethanol, propanol, isopropanol, butanol, etc.), a glycol, an acetate (e.g., ethyl acetate, acetone, etc.), etc., or mixtures thereof.

I. Pretreating Using a Dry Treatment Sheet

In one particular embodiment, a treatment sheet that is substantially dry (i.e., free from any liquid, such as a wetting solution) can be utilized to transfer a treatment composition to the substrate. For instance, the fibrous substrate can be treated prior to forming an image thereon, according to the following method: positioning a dry treatment sheet (e.g., a paper web saturated with a salt) adjacent to the fibrous substrate; thereafter, wetting a backside of the dried treatment sheet with a wetting solution (e.g., via spraying, a sponge, or application of a wet sheet adjacent thereto); pressing the backside of the treatment sheet such that the wetting solution carries the salt from the treatment sheet to the fibrous substrate; and drying the fibrous substrate such that the salt remains in the substrate.

For example, FIGS. 1-3 sequentially show one exemplary method of transferring a treatment composition from a treatment sheet 12 to the substrate 10. As shown in FIG. 1, the treatment sheet 12 is positioned adjacent to the substrate 10. In this embodiment, the treatment sheet 12 can be substantially dry when positioned adjacent to the substrate 10. For example, the treatment sheet 12 can include a base sheet (e.g., a paper web) and a salt, as discussed above. The treatment sheet 12 can be formed, for instance, by saturating the base sheet with a salt solution followed by drying the base sheet to remove the solvent while leaving the salt behind.

A wetting solution 14 can then be applied onto the surface 13 of the dried treatment sheet 12 that is positioned opposite from the substrate 10. For example, as shown in the embodiment of FIG. 2A, the dried treatment sheet 12 can then be wetted via spraying a wetting solution 14 through spray nozzles 16 onto the exposed surface 13 of the dried treatment sheet 12. FIG. 2B shows an alternative embodiment of wetting the dried treatment sheet 12 via a sponge 20 (or similar substance) that has been saturated with the wetting solution 14. Downward pressure (P) can be applied onto the sponge 20 to flow the wetting solution 14 from the sponge 20 into the treatment sheet 12. Additionally, the sponge can be moved across the surface 13 of the treatment sheet 12 in order to saturate the entire area of the treatment sheet 12.

Once the treatment sheet 12 is saturated with the wetting solution 14, pressure (P) can be applied onto the exposed surface 13 of the treatment sheet 12, as shown in FIG. 3. The pressure (P) can cause the wetting solution 14, carrying the solubilized treatment composition (e.g., the salt), to transfer from the treatment sheet 12 into and/or onto the substrate 10. In one embodiment, the wetting solution 14 can saturate the substrate 10 in the treated areas 11 such that a sufficient amount of the treatment composition (e.g., salt) is transferred into the substrate 10.

After transferring the treatment composition from the treatment sheet 12 to the substrate 10, the treatment sheet 12 can be removed from the surface of the substrate 10. The substrate 10 can be then be dried to remove the wetting solution 14 while leaving the treatment composition (e.g., the salt) in and/or on the substrate 10 in the treated areas 11. The image 80 can then be formed on the treated areas 11 of the substrate 10, to form the imaged substrate 10 shown in FIG. 8.

FIGS. 1 and 4-5 sequentially show another exemplary method of transferring a treatment composition from a dried treatment sheet 12 to the substrate 10. As shown in FIG. 1, the treatment sheet 12 is positioned adjacent to the substrate 10, and can be substantially dry as discussed above. Referring to FIG. 4, a wet sheet 42 can then be applied onto the surface 13 of the dried treatment sheet 12 that is positioned opposite from the substrate 10. For example, the wet sheet 42 can be any suitable sheet (e.g., a paper web) that includes a sufficient amount of the wetting solution 14.

As shown in FIG. 5, downward pressure (P) can be applied onto the exposed surface 43 of the wet sheet 42 to flow the wetting solution 14 from the wet sheet 42 into the treatment sheet 12 to solubilize the treatment composition (e.g., the salt) and transfer it into and/or onto the substrate 10. As such, the pressure (P) can cause the wetting solution 14, carrying the solubilized treatment composition (e.g., the salt), to transfer from the treatment sheet 12 into and/or onto the substrate 10. In one embodiment, the wetting solution 14 can saturate the substrate 10 in the treated areas 11 such that a sufficient amount of the treatment composition (e.g., salt) is transferred into the substrate 10.

After transferring the treatment composition from the treatment sheet 12 to the substrate 10, the wet sheet 42 and the treatment sheet 12 can be removed from the surface of the substrate 10. The substrate 10 can be then be dried to remove the wetting solution 14 while leaving the treatment composition (e.g., the salt) in and/or on the substrate 10 in the treated areas 11. The image 80 can then be formed on the treated areas 11 of the substrate 10, to form the imaged substrate 10 shown in FIG. 8.

When utilizing a dried treatment sheet 12, as shown in FIG. 1, any suitable wetting solution 12 can be utilized to solubilize the treatment composition (e.g., the salt). Likewise, the wetting solution 14 can be applied in an amount sufficient to saturate the treatment sheet 12 such that the treatment composition (e.g., the salt) can be solubilized.

II. Pretreating Using a Wet Treatment Sheet

In another embodiment, a treatment sheet that is substantially saturated with the wetting solution (such as discussed above) is positioned adjacent to the substrate in order to transfer a treatment composition to the substrate. For instance, For instance, the fibrous substrate can be treated prior to forming an image thereon, according to the following method: positioning a wet treatment sheet adjacent to the fibrous substrate, wherein the wet treatment sheet comprises a paper web saturated with a treatment composition (e.g., a salt solution); pressing a backside of the treatment sheet such that the wetting solution carries the salt from the treatment sheet to the fibrous substrate; and drying the fibrous substrate such that the salt remains in the substrate.

A. Wet Laminates

In one embodiment, a wet laminate can be used to transfer the treatment composition to the fibrous substrate. The laminate can generally include a wet base sheet that is saturated with the treatment composition and wetting solution and a film layer (e.g., a polymeric film, such as a polyethylene film, a polypropylene film, etc.) configured to provide structural integrity to the wet paper web.

For example, FIGS. 6-7 sequentially show an exemplary method of transferring a treatment composition from a wet treatment sheet 12 to the substrate 10. As shown in FIG. 6, the treatment sheet 12 can, in one embodiment, include a base sheet 60 laminated to a film layer 62 such that the treatment sheet 12 defines a laminate of the base sheet 60 and the film layer 62. The base sheet 60 can be a fibrous web (such as described above) saturated with the treatment composition and the wetting solution. The film layer 62 can provide structural integrity to the base sheet while wet. The film layer 62 can be a polymeric film. FIG. 7 shows transferring the wetting solution 14 from the treatment sheet 12 of FIG. 6 into the substrate 10 via applying pressure (P) onto the exposed surface 63 of the film layer 62.

In other embodiment, the wet treatment sheet 12 can be positioned and pressed (e.g., as shown in FIG. 3) without a film layer present. In such embodiments, the treatment sheet 12 can be substantially strong enough, even when saturated with the wetting solution, to maintain its integrity. For example, a paper web having a basis weight between about 25 gsm and about 350 gsm can be used as the treatment sheet 12. In one particular embodiment, the paper web can be relatively heavy, such as having a basis weight of about 200 gsm to about 325 gsm. Alternatively, a hydroentangled web (e.g., a spunbond web hydroentangled with pulp fibers), a coformed web (e.g., meltblown filaments and at least one secondary material, such as pulp fibers), or other suitable webs can be utilized as the treatment sheet 12. For example, a hydroentangled web with a basis weight between about 50 gsm and about 330 gsm can be used as the treatment sheet 12. In one particular embodiment, the hydroentangled web can have a relatively low basis weight, such as about 75 gsm to about 200 gsm.

B. Treatment Kits and Methods of their Manufacture and Use

A kit containing the treatment sheets and the treatment composition can also be used to supply the required materials to the user in order to pre-treat the fibrous web prior to forming an image thereon. The kit can be designed in any suitable manner, depending on the desired readiness of the kit and/or level of involvement of the end user. As described in greater detail below with respect to specific exemplary embodiments, the treatment sheets can be provided in the kit in varying conditions of readiness for use (e.g., dry or wet). Likewise, the treatment composition can be supplied in a in the kit in varying conditions of readiness for use (e.g., adjacent to the treatment sheets, saturated within the treatment sheets, in a separate treatment container for application to the treatments sheets, etc.).

No matter the configuration or conditions of the kit, each kit will generally include a plurality of treatment sheets positioned within an interior space of a container (e.g., an air-tight container) and a treatment composition (e.g., a salt such as calcium chloride, magnesium chloride, or a mixture thereof, as described above). Instructions can also be provided with the kit, explaining to the user how to treat a fibrous substrate.

Referring to FIG. 9, an exemplary kit 100 is generally shown that includes a container 90 having an inner space 91. A plurality 94 of treatment sheets 12 is shown stacked within the inner space 91 of the container 90. However, it should be understood that the plurality 94 of treatment sheets 12 could be in rolled form, folded form, etc. An instruction sheet 96 is shown with the kit 100, and can be provided with the kit 100 as a separate sheet or as a label on the container 90 or lid 92. The instruction sheet generally includes a description for the user on how to use the kit 100 to pretreat a fibrous substrate.

In the particular embodiment shown, the lid 92 can be fitted onto the container 90 to form an air-tight container that substantially keeps moisture out of the interior space 91 upon closing. Such an air-tight container 90 can help to keep the moisture content of the treatment sheets, whether supplied dry or wet, substantially constant until ready for use upon opening of the container. Thus, the container 90 and lid 92 can be formed from a substantially water-proof and air-tight material.

In the embodiment shown in FIG. 9, the plurality 94 of treatment sheets 12 can be supplied as wet, in that the treatment sheets 12 can be saturated with a treatment composition (e.g., a salt) and wetting solution (e.g., water). Thus, each treatment sheet 12 is ready for (1) positioning a treatment sheet adjacent to a fibrous substrate upon opening of the kit 100, (2) applying pressure to transfer the treatment composition from the treatment sheet 12 into and onto the fibrous substrate 10, (3) removing the treatment sheet 12 from the fibrous substrate 10, (4) drying the fibrous substrate 10, and (5) forming an image over the treated areas 11 of the fibrous substrate 10. The instruction sheet 96 for this embodiment may include such a description.

Alternatively, the plurality 94 of treatment sheets 12 can be supplied as dry sheets, in that the treatment sheets 12 can be substantially free from the wetting solution (e.g., water). In this embodiment, the treatment composition can be provided within each treatment sheet 12 (e.g., presaturated and then dried, as discussed above with respect to FIG. 1), between individual treatment sheets 12 in the plurality 94 (e.g., layered and/or sprinkled between adjacent treatment sheets 12 in the plurality 94), or provided in a treatment pouch separate from the treatment sheets 12. Each of these embodiments are discussed in greater detail below.

When the treatment composition is provided within each treatment sheet 12 (e.g., presaturated and then dried, as discussed above with respect to FIG. 1), a wetting solution 14 can be added to the treatment sheets 12 either before or after positioning adjacent to the fibrous substrate 10. For example, the dry treatment sheets 12 can be utilized according to the embodiment of FIGS. 1-3 as described above. The instruction sheet 96 for this embodiment may include such a description.

Alternatively, a wetting solution 14 can be added to the plurality 94 of dry treatment sheets 12 to wet the sheets prior to positioning on the fibrous substrate 10. Referring to FIG. 10, the wetting solution 14 is shown being added the plurality 94 of treatment sheets 12 to wet the sheets while still in the container 90 and prior to positioning on the fibrous substrate 10. The instruction sheet 96 can include a description of the appropriate amount (volume) of wetting solution 14 to be added to the plurality 94 of treatment sheets 12. The amount of wetting solution 14 and/or the time allotted for a soaking period can vary but will generally be enough volume and long enough to allow each of the treatment sheets 12 in the plurality 94 to be saturated with the wetting solution.

In the exemplary embodiment shown in FIG. 10, the wetting solution 14 is being added to the plurality 94 of treatment sheets 12 utilizing a bucket 102. Markings 104 on the container 90 provide a visual indicator to the user as to the amount of wetting solution 14 to be added to the plurality 94 of treatment sheets 12. After adding the wetting solution 14, the lid 92 can be replaced to allow the plurality 94 of treatment sheets 12 to soak up the wetting solution 14 and become saturated.

In this embodiment, the treatment composition is generally provided within or on each treatment sheet 12. For instance, each of the treatment sheets 12 of the plurality 94 can be presaturated and then dried with the treatment composition, as discussed above with respect to FIG. 1. Alternatively, the treatment composition can be provided in the container 90 so as to be available for solubilizing upon addition of the wetting solution 14 and absorption within the treatment sheets 12. For instance, the treatment composition can be positioned between individual treatment sheets 12 in the plurality 94 (e.g., layered and/or sprinkled between adjacent treatment sheets 12 in the plurality 94).

In the exemplary embodiment of FIG. 11, the treatment composition provided in a pouch 110 separate from the treatment sheets 12. As shown, the treatment composition defines a powder 112 within the pouch 110, but may take on any suitable form (e.g., a concentrated solution/dispersion, a gel, etc.). The pouch 110 can be substantially water-proof and/or air-tight, such that the pouch 110 keeps moisture out of the pouch 110 when sealed. When contained within the pouch 110 (or within the container 90, with either dry or wet sheets 12), sealing the pouch 110 (and/or the container 90) keeps moisture from entering (or exiting, when in the form of a gel or solution) such that the treatment composition substantially retains its packaged form (i.e., dry, wet, or gel) and concentration. For example, when provided in a dry powder form, the treatment composition remains a dry powder until the pouch (and/or container 90) is opened and used. This moisture barrier is particularly useful when the treatment composition includes a salt that is hydrophobic and likely to absorb water over time. Specifically, water or water vapor does not readily move into or out of the pouch 110 in any significant manner. Thus, the user can obtain the kit 100 and follow the provided instructions with confidence that the treatment will be adequately performed.

The instruction sheet 96 in this embodiment can include a description for the user to (1) add the treatment composition in the pouch 110 to a specified amount of a wetting solution 14, (2) allow the treatment composition to solubilize within the wetting solution 14, and (3) add the wetting solution 14 carrying the treatment composition to the plurality 94 of treatment sheets 12, and (4) allow the plurality 94 of treatment sheets 12 to soak up the wetting solution 14 and become saturated. The amount of wetting solution 14 and/or the time allotted for a soaking period can vary, as discussed above, but will generally be enough volume and long enough to allow each of the treatment sheets 12 in the plurality 94 to be saturated with the wetting solution.

Now that the treatment sheets 12 are wet and saturated with the treatment composition, no matter the method of formation (e.g., as described above with respect to FIG. 9, FIG. 10 or FIG. 11), each treatment sheet 12 is ready for (1) positioning a treatment sheet adjacent to a fibrous substrate upon opening of the kit 100, (2) applying pressure to transfer the treatment composition from the treatment sheet 12 into and onto the fibrous substrate 10 (e.g., as shown in FIG. 3), (3) removing the treatment sheet 12 from the fibrous substrate 10, (4) drying the fibrous substrate 10, and (5) forming an image over the treated areas 11 of the fibrous substrate 10. The instruction sheet 96 for this embodiment may include such a description.

Of course, in certain situations, the user may not need to utilize the entire plurality 94 of treatment sheets 12 at once. Thus, if fewer sheets 12 than the entire plurality 94 are to be used, these sheets 12 can be treated by either removing from the container 90 or removing the sheets 12, and then following the provided instructions proportionally (when applicable).

The present invention may be better understood with reference to the following examples.

EXAMPLES

Exemplary pretreatments were performed on a 100% cotton t-shirt (black) using the following method:

A laminate having a basis weight of 61.8 pounds per ream was used to transfer the treatment composition to a cotton t-shirt. The laminate included a paper web (as the base sheet) having a basis weight of 51.5 pounds per ream and a film having a basis weight of 10.3. The paper web was saturated with a solution of $CaCl_2$ in water. The saturated sheet had a weight of 236.5 pounds per ream, so it absorbed nearly quadrupled its weight with the treatment solution. The saturated sheet was positioned on the cotton t-shirt, and pressed in a clam shell heat press (no heat). After pressing, the saturated sheet had a weight of 226.3 pounds per ream, indicating that 10.2 pounds per ream of the treatment solution was transferred into the fabric. This transferred amount corresponds to 4.0 pounds per ream of the dry salt being transferred to the cotton t-shirt.

The wet cotton t-shirt was then dried by pressing in a heat press at 375° F. for about 25 seconds. After cooling, direct-to-garment white inks, available from Brother International Corporation (Bridgewater, N.J.), AnaJet LLC (Costa Mesa, Calif.), and DuPont (Wilmington, Del.), were rolled over the treated area and the non-treated area. The pretreated area exhibited excellent ink hold for each ink.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A method of treating a fibrous substrate prior to forming an image thereon, the method comprising:

positioning a treatment sheet adjacent to the fibrous substrate, wherein the treatment sheet comprises a base sheet saturated with a wetting solution and a salt, the salt comprising calcium chloride, magnesium chloride, or a mixture thereof;

applying pressure onto the treatment sheet using a heat press to flow some of the wetting solution from the treatment sheet into the fibrous substrate to carry the salt from the treatment sheet into the fibrous substrate;

removing the treatment sheet from the fibrous substrate;

drying the fibrous substrate such that the salt remains in the substrate to define a treated area; and thereafter, forming an image on the treated area.

2. The method of claim 1, wherein the salt comprises calcium chloride.

3. The method of claim 1, wherein the salt comprises magnesium chloride.

4. The method of claim 1, wherein the treatment sheet comprises a film layer attached to the base sheet, wherein the film layer is configured to provide structural integrity to the base sheet while wet.

5. The method of claim 1, wherein the base sheet comprises a paper web, a hydroentangled web, or a coform web.

6. The method of claim 1, wherein the base sheet comprises pulp fibers.

7. The method of claim 1, wherein the base sheet has a basis weight between about 25 gsm and about 350 gsm.

8. The method of claim 1, wherein the wetting solution comprises water.

9. The method of claim 1, wherein the base sheet is saturated with a mixture of salts.

10. The method of claim 9, wherein the mixture of salts comprises calcium chloride.

11. The method of claim 1, wherein the treatment sheet is substantially strong enough by itself to maintain its integrity so that it may be positioned and pressed without a film layer present.

12. The method of claim 11, wherein the base sheet comprises pulp fibers, and wherein the base sheet has a basis weight between about 25 gsm and about 350 gsm.

13. The method of claim 12, wherein the base sheet is a paper web having a basis weight of about 200 gsm to about 325 gsm.

14. The method of claim 13, wherein the wetting solution further comprises an alcohol, a glycol, an acetate, or mixtures thereof.

15. The method of claim 1, wherein the image is formed on the treated area via direct-to-garment printing.

16. The method of claim 1, wherein the image is formed on the treated area via a heat transfer method.

17. The method of claim 1, wherein drying the fibrous substrate comprises pressing the fibrous substrate in a heat press.

18. The method of claim 1, wherein the fibrous substrate is not heated when applying pressure onto the treatment sheet using the heat press.

19. The method of claim 1, wherein the method comprises using a kit configured to provide the treatment sheet impregnated with the wetting solution and the salt.

* * * * *